US006443127B1

(12) United States Patent
Bootle et al.

(10) Patent No.: US 6,443,127 B1
(45) **Date of Patent: *Sep. 3, 2002**

(54) GOVERNOR

(75) Inventors: Geoffrey David Bootle, Maidston; William Robert Burborough, Gillingham, both of (GB)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/451,258

(22) Filed: Nov. 29, 1999

(30) Foreign Application Priority Data

Dec. 5, 1998 (GB) ..... 9826756

(51) Int. Cl.[7] ..... F02M 37/04
(52) U.S. Cl. ..... 123/364; 123/450
(58) Field of Search ..... 123/364, 365, 123/373, 371, 372, 450

(56) References Cited

U.S. PATENT DOCUMENTS

| | | | | | |
|---|---|---|---|---|---|
| 2,641,238 | A | * | 6/1953 | Roosa | 123/450 |
| 2,949,904 | A | * | 8/1960 | Bischoff et al. | 123/364 |
| 3,439,624 | A | * | 4/1969 | Glikin et al. | 123/450 |
| 3,460,479 | A | * | 8/1969 | Kemp | 123/364 |
| 3,650,259 | A | * | 3/1972 | Garnier | 123/364 |
| 4,098,249 | A | * | 7/1978 | Mowbray | 123/450 |
| 4,793,311 | A | * | 12/1988 | Salzgeber et al. | 123/450 |
| 5,123,393 | A | * | 6/1992 | Djordjevic | 123/502 |
| 5,180,290 | A | * | 1/1993 | Green | 123/450 |
| 5,203,303 | A | * | 4/1993 | Collingborn et al. | 123/450 |
| 5,394,851 | A | * | 3/1995 | Cryer et al. | 123/476 |

FOREIGN PATENT DOCUMENTS

GB 2 295 463 5/1996

* cited by examiner

*Primary Examiner*—Carl S. Miller
(74) *Attorney, Agent, or Firm*—Wells St. John P.S.

(57) ABSTRACT

A governor comprising a centrifugal weight mechanism coupled to an angularly adjustable metering valve member and an adjuster for adjusting the axial position of the meeting valve member to permit droop control.

12 Claims, 2 Drawing Sheets

FIG 1
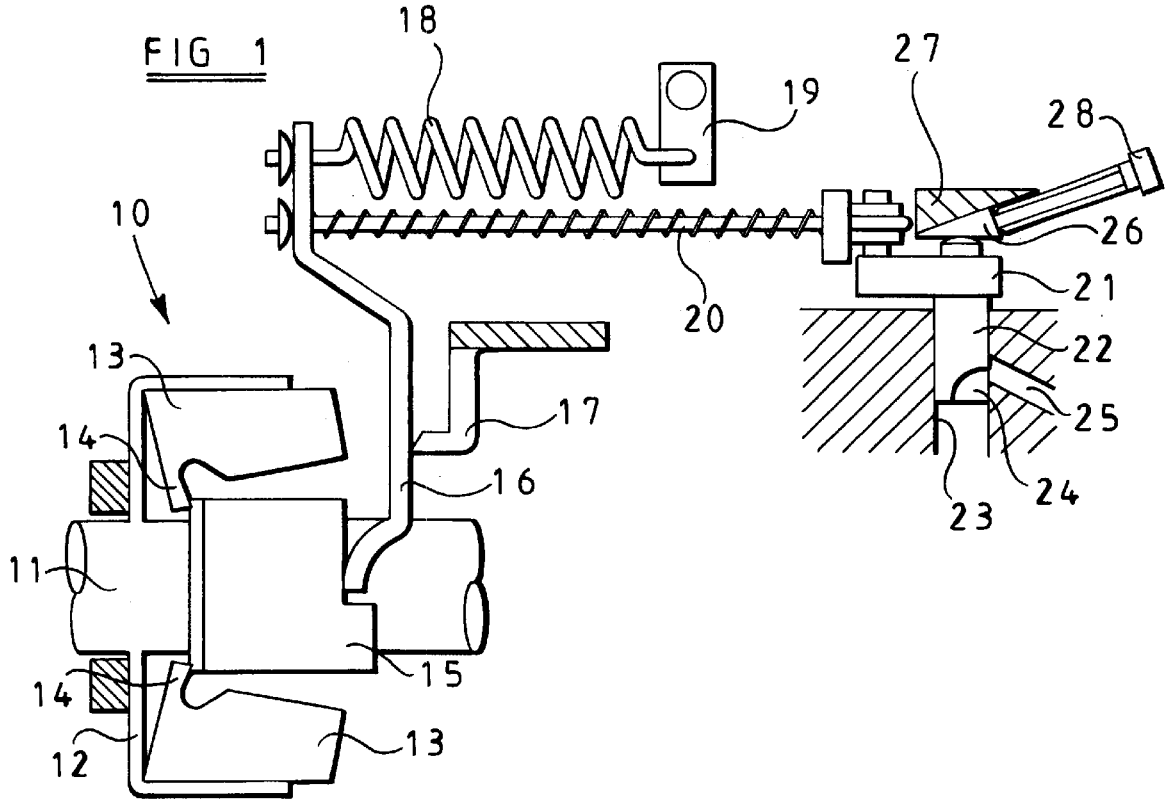
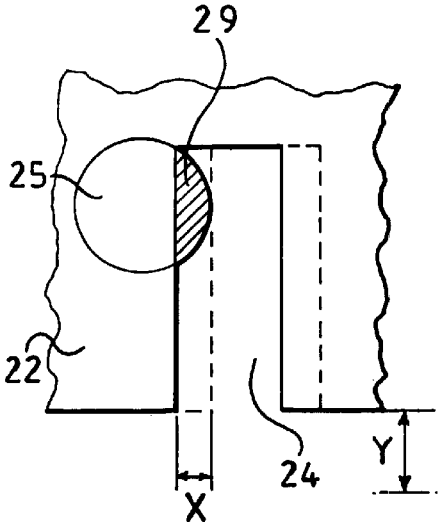
FIG 2
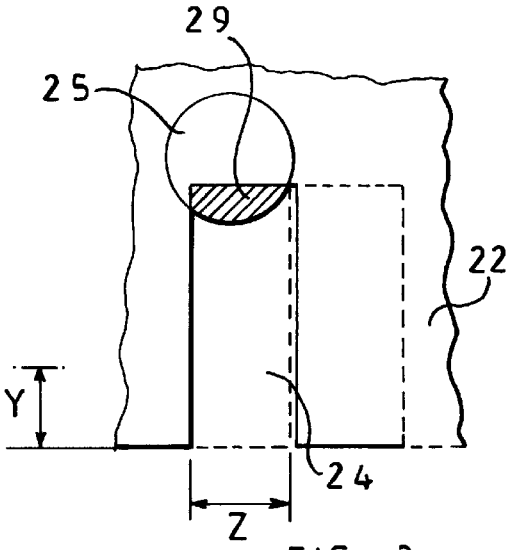
FIG 3

30
32a
32
34
22a
32b
32c
38
36
22
25

GOVERNOR

This invention relates to a governor for use in controlling the rate at which fuel is supplied to a fuel pump, and thus for use in controlling the operation of an engine of the compression ignition type.

A governor for use with a diesel engine of an alternator and generator set typically comprises a centrifugal weight mechanism arranged to rotate at a speed associated with engine speed and to act upon a spring biased lever, the lever being coupled to a fuel metering valve such that movement of the lever is transmitted to the valve to adjust the setting of the valve. In particular, the governor is arranged such that in the event that the load on the engine changes, a corresponding change in the fuelling of the engine is made to control the engine in such a manner that it operates at a substantially constant speed.

It is desirable to be able to adjust the governor to permit control over the change in engine speed which must occur in order for the metering valve to move between its fully open and closed positions. Such adjustment is known as "droop" adjustment or control and is desirable as it allows the governor to be controlled to compensate for wear and for variations in the output of governors of identical nominal specifications. Droop control may also be used to improve the stability of the system, for example to limit engine speed oscillations following a rapid change in load.

According to the present invention there is provided a governor comprising a centrifugal weight mechanism coupled to an angularly adjustable metering valve member, and means for adjusting the axial position of the meeting valve member to permit droop control.

The invention also relates to a method of adjusting the droop of a governor comprising adjusting the axial position of a metering valve to adjust the variation in engine speed necessary to move the metering valve between two predetermined fuelling levels.

The invention will further be described, by way of example, with reference to the accompanying drawings, in which:

FIG. 1 is a diagrammatic view of a governor in accordance with an embodiment of the invention;

FIGS. 2 and 3 are diagrams illustrating the operation of the embodiment of FIG. 1.

Figure 4:
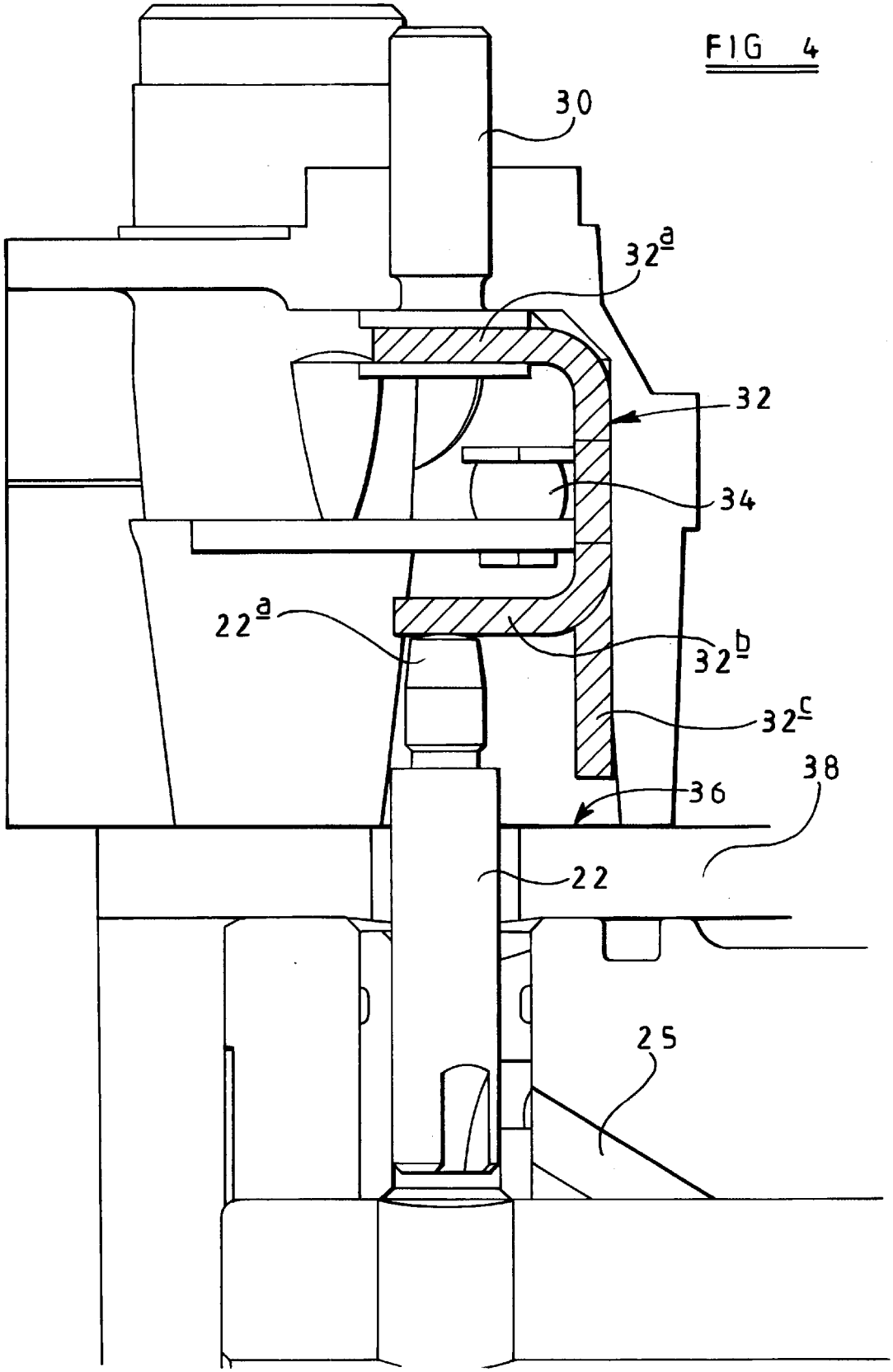
FIG. 4 is a schematic view of a part of a governor in accordance with an alternative embodiment.

The accompanying drawings illustrate a governor which comprises a centrifugal weight mechanism 10 mounted upon a shaft 11 which is arranged to rotate at a speed associated with the operating speed of an associated engine, for example cam shaft or crank shaft speed. The shaft 11 carries a cage 12, the cage 12 being rotatable with the shaft 11. A plurality of weights 13 are pivotally mounted within the cage 12. Each of the weights 13 includes a projection 14 which is engageable with an end surface of a sleeve 15, the sleeve 15 being axially adjustable relative to the shaft 11. The sleeve 15 abuts a lever 16, the lever 16 being pivotable about an arm 17. A governor spring 18 is secured to the lever 16, the governor spring 18 engaging a throttle member 19 which is adjustable to vary the preload applied to the spring 18.

In use, when the engine is operating at a relatively low speed, and hence the shaft 11 rotates at a relatively low speed, the action of the governor spring 18 upon the lever 16 applies a force to the sleeve 15 urging the sleeve 15 towards the left in the orientation illustrated in FIG. 1, the engagement between the sleeve 15 and the weights 13 ensuring that the weights 13 occupy a radially inner position. As the engine speed increases, the centrifugal force resulting from the increased speed of rotation of the shaft 11 urges the weights 13 to pivot towards radially outer positions, such movement causing translation of the sleeve 15, and pivotal movement of the lever 16 against the action of the governor spring 18.

The lever 16 is coupled through a conventional coupling arrangement 20 to a crank 21 mounted upon an upper end region of a metering valve member 22 which is angularly adjustable within a bore 23. The bore 23 is arranged to be supplied with fuel, at relatively low pressure, by a transfer pump which is conveniently operated at a speed associated with engine speed.

The metering valve member 22 is provided, at its lower end, with a recess 24 which is registrable with an outlet 25 such that, depending upon the angular position of the metering valve member 22, fuel from the transfer pump can be supplied through the bore 23 and recess 24 to the outlet 25. The outlet 25 communicates with an inlet of a high pressure fuel pump which is used to supply fuel at high pressure to injectors associated with each cylinder of the engine. The high pressure fuel pump may, for example, take the form of a rotary distributor pump. However, it will be appreciated that the invention is also applicable to governors for use with fuel systems including high pressure fuel pumps of other types.

The governor of FIG. 1 further comprises a droop adjustment arrangement which comprises a wedge member 26 slidable upon a ramped surface of a member 27, an adjustment screw being provided to adjust the position of the wedge member 26. The wedge member 26 abuts the upper end of the metering valve member 22 such that adjustment of the adjustment screw 28 to cause a change in the position of the wedge member 26 causes the metering valve member 22 to move axially relative to the bore 23.

FIGS. 2 and 3 illustrate the effect of adjusting the axial position of the metering valve member 22. In FIGS. 2 and 3, the shaded region 29 denotes the region of overlap between the end of the outlet 25 and the recess 24 provided in the metering valve member 22 when the valve member 22 occupies a fully open position. The fully open position may be defined or determined using, for example, scroll or catch plates or other stops for limiting angular adjustment of the valve member 22. In both FIG. 2 and FIG. 3, the region of overlap relates to a flow area of, for example, 2 $mm^2$. In the arrangement of FIG. 2, the dashed line indicates the position of the recess 24 when the metering valve member 22 is moved to a closed position in which there is no overlap between the recess 24 and the outlet 25. The movement of the metering valve member 22 between these positions is denoted by arrow X. It will be appreciated, however, that the movement of the metering valve member 22 is an angular movement, and not a linear movement.

FIG. 3 illustrates the movement of the metering valve member 22 between its fully open position and closed positions where the axial position of the metering valve member 22 has been shifted through a distance Y. As illustrated in FIG. 3, the degree by which the valve member 22 must move in order to move between its fully open and fully closed positions, denoted by arrow Z in FIG. 3 is significantly greater than the corresponding distance, distance X, shown in FIG. 2.

Although in the accompanying figures the outlet 25 is shown to have a cross section of circular form, it will be appreciated that the outlet 25 may take an alternative form. For example, it may be desirable to provide an outlet 25 of rectangular form. The shape of the outlet 25 determines the sensitivity of the metering valve arrangement and the shape of the outlet can therefore be chosen to provide the sensitivity required for the particular application of the governor.

As the metering valve member 22 is coupled to the centrifugal weight mechanism 10, it will be appreciated that the angle through which the metering valve member 22 is moved is related to the change in engine speed. It will therefore be appreciated that when the valve member 22 occupies the axial position shown in FIG. 2, the valve member 22 moves between a fully open and a fully closed position as a result of a relatively small change in engine speed, the arrangement of FIG. 3 in which the metering valve member 22 occupies a lower axial position requiring the engine speed to vary by a greater amount to cause the same change in fuelling level.

In use, with the engine operating at a given speed against a given load, the speed being determined by the setting of the throttle member 19, if the load falls, then the engine speed will increase. The increase in engine speed causes the weights 13 to move radially outward, this movement being transmitted to the lever 16, the lever 16 moving against the action of the spring 18. The movement of the lever 16 is transmitted to the metering valve member 22, moving the valve member 22 to a position in which the rate of fuel supply to the high pressure fuel pump is reduced. As a result of the reduction in fuelling, the engine speed will fall, the governor returning the engine to substantially its original speed. Similarly, if the load on the engine increases, the governor changes the engine fuelling level to correct for the change in load.

It will be appreciated that, if in use, as a result of wear or for system stability reasons, or for any other reason, the droop of the governor changes or needs changing, then by appropriate adjustment of the adjustment screw 28, the axial position of the metering valve member 22 can be adjusted to achieve the desired level of droop. As a result, the operation of the governor to control the engine so that the engine operates at a substantially constant speed can be improved.

Referring to FIG. 4, in an alternative embodiment of the invention the adjustment of the axial position of the metering valve member 22 is achieved by means of an adjustment screw 30 which is arranged substantially vertically above the metering valve member 22, in the orientation shown in FIG. 1. The lowermost end of the adjustment screw 30 is provided with a groove which cooperates with an upper arm 32*a* of an intermediate bridge member 32. The bridge member 32 also includes a lower arm 32*b*, a surface of the lower arm 32*b* being in abutment with an upper surface of a spigot 22*a* forming part of the metering valve member 22. In this embodiment of the invention, the axial position of the metering valve member 22 can be adjusted by adjusting the position of the adjustment screw 30 along an axis which is substantially coaxial with the axis of the metering valve member 22, adjustment of the position of the adjustment screw 30 being transmitted to the metering valve member 22 through the bridge member 32. The provision of the bridge member 32 permits accommodation of a part of the throttle linkage 34 and a control arm (not shown) for the metering valve member 22.

The bridge member 32 also includes a leg portion 32*c*, the leg portion 32*c* being engageable with a surface 36 associated with a housing 38 to limit the extent of movement of the bridge member 32 along the axis of the metering valve member 22. As movement of the bridge member 32 is limited in this way, the position of the metering valve member 22 is prevented from being adjusted to such an extent that the metering valve is driven too far into the housing 38 causing it to jam, thereby causing a hazard to the correct operation of the governor. By using the adjustment screw 30 to adjust the position of the metering valve member 22 in this way, it will be appreciated that the need for the wedge member 26 and the ramped surface 27, as shown in FIGS. 1 to 3, is removed.

What is claimed is:

1. A governor for use with a diesel engine of an alternator and generator set which operates, in use, at a substantially constant speed, comprising:

a centrifugal weight mechanism coupled to a metering valve member arranged in a flow path between a transfer pump and an inlet of a high pressure fuel pump, the centrifugal weight mechanism being operable to adjust the angular position of the metering valve member so as to vary the rate of flow delivered by the transfer pump to the inlet of the high pressure fuel pump, thereby to maintain engine operation at the substantially constant speed, the metering valve member having a metering valve axis and an axial position and being angularly adjustable about the metering valve axis between a fully open position and a fully closed position, and an adjuster member for adjusting said axial position of the metering valve member, wherein said adjuster member is arranged to have an axis parallel to the axis of the metering valve member and to act on a non-rotatable intermediate bridge member, wherein said non-rotatable intermediate bridge member acts on a surface associated with said metering valve member such that adjustment of said adjuster member along its axis causes said axial position of said metering valve member to be adjusted through the intermediate member, thereby to permit adjustment of the rate of change of flow to the high pressure pump with engine speed.

2. The governor as claimed in claim 1, wherein the adjuster member for adjusting the axial position of the metering valve member has its axis substantially aligned with the axis of the metering valve member.

3. The governor as claimed in claim 1, wherein the non-rotatable, intermediate bridge member includes a U-shaped portion having first and second arms, a surface of the first arm co-operating with the adjuster member, and a surface of the second arm co-operating with the metering valve member.

4. The governor as claimed in claim 1, wherein the adjuster member for adjusting the axial position of the metering valve member is an adjustment screw.

5. The governor as claimed in claim 1, wherein said non-rotatable intermediate bridge member includes a leg portion which serves to limit the extent of adjustment of said axial position of said metering valve member.

6. A governor for use with a diesel engine of an alternator and generator set which operates, in use, at a substantially constant speed, comprising:

a centrifugal weight mechanism coupled to a metering valve member arranged in a flow path between a transfer pump and an inlet of a high pressure fuel pump, the centrifugal weight mechanism being operable to adjust the angular position of the metering valve member so as to vary the rate of flow delivered by the transfer pump to the inlet of the high pressure fuel pump, thereby to maintain engine operation at the substantially constant speed, the metering valve member having an axial position and being angularly adjustable between a fully open position and a fully closed position, and an adjuster member for adjusting said axial position of the metering valve member through an intermediate wedge member, wherein a first surface of the intermediate wedge member is slidable upon a ramped surface and a second surface of the intermediate wedge member is in abutment with an end of the metering valve member, wherein the wedge member is movable laterally with respect to the metering valve member upon adjustment of the adjuster member along its axis, thereby to adjust said axial position of said metering valve member so as to permit adjustment of the rate of change of flow to the high pressure pump with engine speed.

7. The governor as claimed in claim 6, wherein said adjustment member is an adjustment screw.

8. The governor as claimed in claim 6, wherein said metering valve member is provided with a recess which is registerable with an outlet to determine a fuelling level through said outlet, in use.

9. The governor as claimed in claim 8, wherein said metering valve member is angularly movable between the fully open position, in which said recess and said outlet overlap to provide a maximum fuelling level, and the fully closed position in which there is substantially no overlap between said recess and said outlet.

10. The governor as claimed in claim 9, and further comprising a stop for limiting angular adjustment of said metering valve member to determine said maximum fuelling level.

11. The governor as claimed in claim 10, wherein said stop takes the form of catch plates or scroll plates.

12. A method of controlling a governor for a diesel engine of an alternator and generator set which operates, in use, at a substantially constant speed, a metering valve member of the governor being operable between a fully open and a fully closed position, and being arranged in a flow path between transfer pump and an inlet of a high pressure fuel pump, the method comprising, providing an adjuster member having an adjuster member axis, providing a metering valve member having a metering valve axis and an axial position within a bore, locating a non-rotatable intermediate bridge member between the metering valve member and the adjuster member, such that the axis of the adjuster member is substantially parallel to the axis of the metering valve member and the adjuster member acts on the metering valve member through the intermediate member, adjusting the angular position of the metering valve member within the bore to vary the rate of flow of fuel delivered from the transfer pump to the inlet of the high pressure fuel pump so as to maintain engine operation at the substantially constant speed, and axially adjusting the adjuster member so as to adjust the axial position of the metering valve member through the intermediate member so as to adjust the variation in engine speed necessary to move said metering valve member between two predetermined fuelling levels.

* * * * *